United States Patent [19]

Ullmann

[11] Patent Number: 5,020,796

[45] Date of Patent: Jun. 4, 1991

[54] EXPANDER TYPE EXERCISING APPARATUS

[76] Inventor: Martin Ullmann, Tellenweg 1, CH-9030 Abtwil, Switzerland

[21] Appl. No.: 486,530

[22] Filed: Feb. 28, 1990

[51] Int. Cl.[5] ..... A63B 21/055

[52] U.S. Cl. ..... 272/143; 272/142

[58] Field of Search ..... 272/75, 125, 126, 140, 272/143, DIG. 4, 135, 142

[56] References Cited

U.S. PATENT DOCUMENTS

| | | | |
|---|---|---|---|
| 1,307,905 | 6/1919 | Hendrickson | 272/142 X |
| 4,026,549 | 5/1977 | Gunn | 272/143 X |
| 4,040,620 | 8/1977 | Friedman | 272/143 X |
| 4,047,714 | 9/1977 | Powell | 272/126 X |

*Primary Examiner*—Richard J. Apley

*Assistant Examiner*—L. Thomas

*Attorney, Agent, or Firm*—Peter K. Kontler

[57] ABSTRACT

An expander type exercising apparatus has an elongated stretchable elastic element consisting of one or more coil springs, elastic tubes and/or elastic strands. The elastic element is confined in the median portion of an elongated tube-like envelope the end portions of which are directly or indirectly secured to and extend beyond the respective ends of the elastic element. The end portions of the envelope have looped sections which constitute handles to be grasped by a person wishing to stretch the elastic element by way of the two end portions of the envelope. The sizes of the looped sections are adjustable to thus change the overall length of the apparatus. The envelope consists of filaments which are woven around the elastic element while the latter is maintained in stretched condition.

14 Claims, 1 Drawing Sheet

EXPANDER TYPE EXERCISING APPARATUS

BACKGROUND OF THE INVENTION

The invention relates to exercising apparatus in general, and more particularly to improvements in exercising apparatus of the type known as expanders.

Expanders are used by person wishing to exercise and strengthen the muscles in their hands and in other parts of their bodies. A conventional expander comprises one or more elongated coil springs the end portions of which are connected with handles, e.g., with handles in the form of rings. Such expanders are simple, inexpensive and effective. However, a careless or clumsy person is likely to sustain serious injuries as a result of improper manipulation of a conventional expander with one or more coil springs. For example, if one of the handles is released in stretched condition of the coil spring or springs (this can happen if the hands of the person using the expander perspire as a result of prolonged strenuous exercising), the spring or springs are free to abruptly contract and to propel the released handle against the body of the user or to injure a person standing by. Moreover, conventional expanders (especially those for use by adults seeking strenuous exercise) are heavy and bulky and, therefore, not suitable for taking along on trips so that the owner could carry out her or his daily exercise at home or elsewhere.

OBJECTS OF THE INVENTION

An object of the invention is to provide a novel and improved expander type exercising apparatus (hereinafter called expander for short) which is simpler, more compact, lighter and safer than heretofore known expanders.

Another object of the invention is to provide an expander of variable length which can be adjusted in a simple and time-saving manner without the need for tools of any kind.

A further object of the invention is to provide a novel method of making the expander.

An additional object of the invention is to provide the above outlined expander with novel and improved handles which are less likely to be accidentally released than the handles of a conventional expander.

Still another object of the invention is to provide a novel and improved stretchable elastic element for use in the above outlined expander.

A further object of the invention is to provide an expander which can be readily collapsed into a relatively small and handy package for storage in a suitcase, in a bag or in any other container which accompanies the owner on trips.

An additional object of the invention is to provide the expander with simple but effective means for limiting the extent of stretchability of the elastic element.

SUMMARY OF THE INVENTION

One feature of the invention resides in the provision of an expander which comprises a stretchable elongated elastic element having a first end and second end, and an envelope which includes a longitudinally deformable elongated median portion surrounding the elastic element and first and second end portions which are directly or indirectly secured to and extend beyond the respective ends of the elastic element. The end portions of the envelope include or constitute handles which can be grasped by the hands of a person preparatory to stretching of the elastic element by way of the end portions of the envelope. The envelope can include or constitute an elongated tube of woven filaments. Such filaments are preferably interwoven directly around the elastic element while the latter is maintained in stretched condition.

Each of the handles can constitute a looped section of the respective end portion of the envelope.

The elastic element can include or consist of one or more coil springs, one or more flexible hoses of elastomeric material and/or one or more preferably endless strands of elastomeric material.

The expander can further include a cord comprising first and second portions which are affixed to the respective ends of the elastic element and extend along the respective end portions of the envelope. Such cord can further comprise an elongated intermediate portion between the first and second portions. The length of the intermediate portion of the cord exceeds the length of the unstretched elastic element. The entire cord can be confined in the envelope.

At least one end portion of the envelope can be provided with at least one opening through which a portion of the looped section of the respective end portion extends. The arrangement is preferably such that the at least one end portion of the envelope has two longitudinally spaced apart openings and the aforementioned portion of the respective looped section extends into the envelope by way of one of the openings and out of the envelope by way of the other opening. This renders it possible to adjust the size of the at least one looped section and hence the distance of the hand holding the adjustable looped section from the respective end of the elastic element. In other words, it is possible to change the overall length or effective length of the envelope by the simple expedient of adjusting the size of the one and/or the other looped section.

The combined length of the end portions of the envelope can exceed, and even greatly exceed, the length of the unstretched elastic element.

Another feature of the invention resides in the provision of a method of making an expander. The method comprises the steps of stretching an elongated elastic element, weaving a tubular envelope around and beyond the ends of the stretched elastic element so that the finished envelope comprises a median portion surrounding the stretched elastic element and two end portions extending beyond the respective ends of the elastic element, and permitting the elastic element to contract with attendant shortening and thickening of the median portion of the envelope. The method preferably further comprises the step of converting each end portion of the envelope into a handle.

The novel features which are considered as characteristic of the invention are set forth in particular in the appended claims. The improved expander itself, however, both as to its construction and the mode of making and using the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
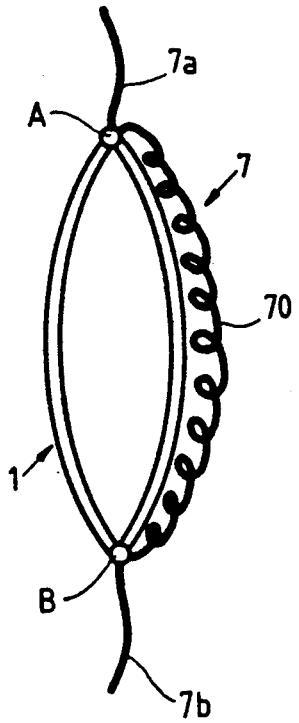
FIG. 1 is a schematic elevational view of a portion of an expander which embodies one form of the invention, the elastic element and the cord being shown in unstretched condition.

FIGS. 1 to 4 show a first expander 3 which comprises an elongated elastic element 1 composed of a plurality of strands 5 of rubber or other elastomeric material. The strands 5 can form a plurality of endless components. The two ends A and B of the elastic element 1 are connected with the adjacent portions 7*a*, 7*b* of an elongated cord 7 which further includes an intermediate portion 7*c* extending between the ends A and B. The length of the intermediate portion 7*c* exceeds the length of the unstretched elastic element 1 and is or can be selected in such a way that it determines the maximum stretchability of the element 1. For example, the length of the intermediate portion 7*c* can exceed the length of the unstretched elastic element 1 by 50 to 60 percent.

The expander 3 further comprises an elongated deformable tubular envelope 9 composed of filaments which are preferably woven around the elastic element 1 while the latter is maintained in fully stretched condition. The envelope 9 comprises a median portion 9*a* which confines the elastic element 1, and two end portions 11, 13 which respectively extend beyond the ends A and B of the element 1. The cord 7 is fully confined in the envelope 9, i.e., the intermediate portion 7*c* is confined in the median portion 9*a* and the portions 7*a*, 7*b* are respectively confined in the end portions 11 and 13.

Figure 3:
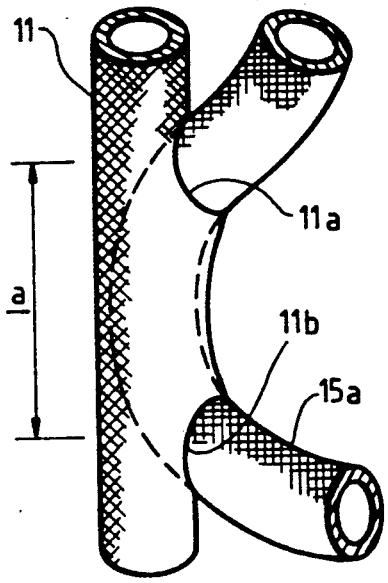
FIG. 3 is an enlarged view of a detail within the circle III in FIG. 2, with the cord omitted.

The end portion 11 has a looped section 15 which constitutes one handle, and the end portion 13 has a looped section 17 which constitutes the other handle of the expander 3. As can be seen in FIG. 3, the end portion 11 has two longitudinally spaced apart openings 11*a*, 11*b* for a portion 15*a* of the looped section 15. The portion 15*a* extends into the interior of the envelope 9 by way of the opening 11*a* and out of the envelope by way of the opening 11*b*. Similar openings are provided in the end portion 13 for a portion of the looped section 17.

The weaving machine (not shown) which is used to make the envelope 9 has means for engaging the ends A and B of the elastic element 1 and for stretching the element 1 to maximum length. The machine then weaves the envelope 9 directly around the thus stretched elastic element 1 and around the cord 7. When the weaving operation is completed, the elastic element 1 contracts and causes contraction and thickening of median portion 9*a* of the envelope 9 (see FIG. 2). The end portions 11, 13 do not or need not contract and are indirectly secured to the respective ends A, B of the element 1 by the portions 7*a*, 7*b* of the cord 7 so that, when the hands of the user grasp the looped sections or handles 15, 17 and the user moves her or his hands apart, the element 1 is stretched and causes a proportional lengthening of the median portion 9*a*. The intermediate portion 7*c* of the cord 7 can serve to determine the maximum extent of stretchability of the element 1.

Figure 4:
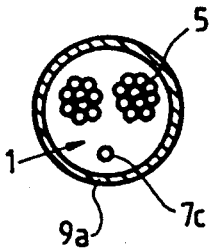
FIG. 4 is an enlarged transverse sectional view as seen in the direction of arrows from the line IV—IV of FIG. 2.

The sizes of the looped sections 15, 17 remain unchanged when such sections are engaged by the hands of a user to serve as handles for stretching of the elastic element 1. This is due to the fact that the end portions 11, 13 are flattened as a result of the application of tensional stress and frictionally engage the portions 15*a*, 17*a* of the respective looped sections 15, 17. However, if the user wishes to adjust the initial length 1 of the expander 3, the tensional stress upon the end portions 11, 13 is relaxed to permit convenient shifting of the portions 15*a*, 17*a* relative to the adjacent parts of the corresponding end portions 11 and 13. The distance a between the centers of holes 11*a*, 11*b* which are shown in FIG. 4 suffices to ensure the establishment of a pronounced frictional engagement between the portion 15*a* and the adjacent part of the end portion 11 when the user exerts a pull upon the looped section 15. The same applies for frictional engagement between the portion 17*a* and the adjacent part of the end portion 17.

The combined length of the end portions 11, 13 considerably exceeds the length of the unstretched elastic element 1. In fact, the length of the end portion 11 or 13 can and normally does exceed the length of the unstretched element 1.

Figure 2:
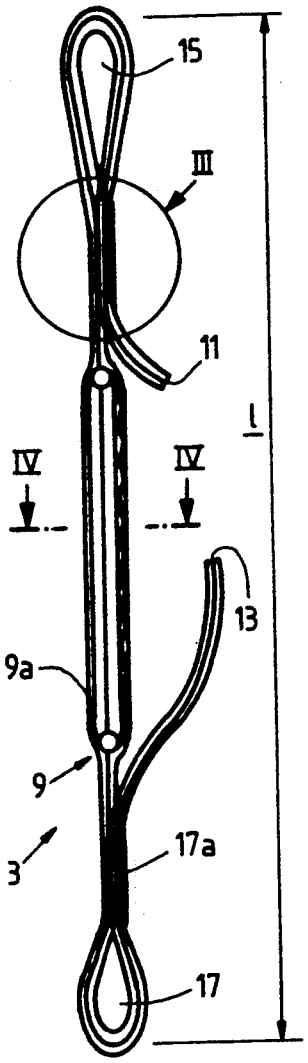
FIG. 2 is an elevational view of the finished expander with the elastic element in unstretched condition.

It is not absolutely necessary that the size of the looped section 15 match the size of the looped section 17. FIG. 2 shows, by way of example, that the looped section 15 is larger than the looped section 17. If the user wishes to increase the "hardness" of the expander 3, she or he reduces the size of at least one of the looped sections 15, 17. On the other hand, the expander 3 will become "softer" in response to an increase of its effective length 1. The portions 15*a*, 17*a* of looped sections 15, 17 are caused to jam in the adjacent parts of the respective end portions 11, 13 as soon as the looped portions 15, 17 are grasped and pulled away from each other. Excessive stretching of the elastic element 1 is prevented by the intermediate portion 7*c* of the cord 7 as well as by the median portion 9*a* of the envelope 9. The median portion 9*a* can by lengthened to the extent corresponding to the length of the stretched element 1 during weaving of the envelope 9. Once the median portion 9*a* reaches its initial length, it acts as a rope and prevents further stretching of the element 1. In view of such function of the median portion 9*a*, the cord 7 constitutes an optional feature of the expander 3. If the cord 7 is omitted, the end portions 11, 13 of the envelope 9 are connected directly to the respective ends A, B of the elastic element 1. Such connections can be established during weaving of the envelope 9 around the element 1.

Figure 5:
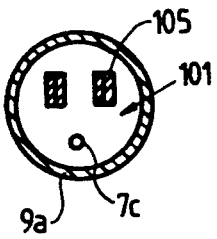
FIG. 5 is a similar sectional view but showing a modified elastic element.

The hardness of the expander 3 can be varied in the above outlined manner, namely by changing the effective length 1, and also by increasing or reducing the number of strands 5, by selecting the elasticity of the strands and/or by selecting the diameters of the strands. FIG. 4 shows that the strands 5 have a circular cross-sectional outline. FIG. 5 shows a modified elastic element 101 with strands 105 having a rectangular cross-sectional outline. Each strand 105 offers much greater resistance to stretching than a strand 5.

Figure 7:
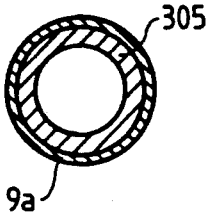
FIG. 7 is a similar sectional view but showing a fourth elastic element.
Figure 6:
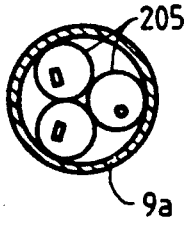
FIG. 6 is a similar sectional view but showing a third elastic element.

FIG. 6 shows that the median portion 9*a* of the envelope confines a total of three coil springs 205. The elastic element of FIG. 7 is a flexible hose 305 of elastomeric material. This hose can be made of foam rubber. As a rule, the extent of stretchability of a hose is considerably less than that of a coil spring or a strand; such stretchability is determined exclusively by the reduction of diameter of the stretched hose. It is also possible to employ an elastic element which consists of a single elongated solid strand of elastomeric material or to employ an elastic element which is assembled of a small or very small number (e.g., two or three) of elongated strands of elastomeric material.

An advantage of the improved expander is that its manipulation is much less likely to cause serious injury than that of a conventional expander, e.g., an expander with one or more exposed coil springs having end portions connected with handles in the form of rings or the like. The reason is that the elastic element need not comprise any metallic parts (even though it can comprise or consist of one or more coil springs) and also that the elastic element is confined in a readily deformable envelope 9 which is highly unlikely to cause injury to the user, even to a very careless user. Moreover, the handles (looped sections) 15 and 17 are soft in contrast to the normally rigid handles of conventional expanders.

Another advantage of the improved expander is its low cost. The expander can be readily collapsed into a very small package which occupies little room in a drawer, suitcase, bag or other container or receptacle so that the expander can be taken along on trips, vacations and elsewhere to ensure that the user can exercise every day or as often during each day as desired irrespective of whether at home or away from home. The effective length 1 of the expander can be changed within a very short interval of time, with a minimum of effort and without resorting to any (even most rudimentary) tools. As a rule, or at least in many instances, the elasticity of the element 1 or another element in the envelope 9 will be selected in such a way that the length of this element can be increased by up to approximately 50 percent. The user can infinitely vary the effective length, and hence the hardness or softness, of the expander.

Still further, the textile material of the looped portions 15, 17 can be more readily grasped by hands than rigid handles of metal or plastic. Moreover, the textile material of end portions 11, 13 will or can absorb perspiration so that the hands of the user are less likely to slide off the looped sections 15, 17 than if such looped sections were to be replaced by rigid handles. However, it is within the purview of the invention to attach separately produced handles to the end portions 11, 13 of the envelope 9.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An expander comprising a stretchable elongated elastic element having a first end and a second end; and an envelope including a longitudinally deformable elongated median portion surrounding said elastic element, and first and second end portions secured to and both extending beyond the respective ends of said elastic element, said end portions including handles which are spaced apart from the respective ends of said elastic element and can be grasped by the hands of a person preparatory to stretching of the elastic element by way of said end portions.

2. The expander of claim 1, wherein said envelope includes an elongated tube of woven filaments.

3. The expander of claim 1, wherein each of said handles constitutes a looped section of the respective end portion.

4. The expander of claim 1, wherein said elastic element includes at least one elongated coil spring.

5. The expander of claim 1, wherein said elastic element includes at least one flexible hose of elastomeric material.

6. The expander of claim 1, wherein said elastic element includes at least one endless strand of elastomeric material.

7. The expander of claim 1, wherein said envelope includes an elongated tube consisting of filaments interwoven around the elastic element in stretched condition of the elastic element.

8. The expander of claim 1, further comprising a cord having first and second portions affixed to the respective ends of said elastic element and extending along said end portions.

9. The expander of claim 8, wherein said cord further comprises an elongated intermediate portion between said first and second portions thereof, the length of said intermediate portion exceeding the length of the unstretched elastic element.

10. The expander of claim 9, wherein said cord is confined in said envelope.

11. The expander of claim 1, wherein at least one of said end portions has at least one opening and the respective handle is a looped section of said at least one end portion, said looped section including a portion extending through said at least one opening.

12. The expander of claim 11, wherein said one end portion has two openings, said portion of said looped section extending into said envelope by way of one of said openings and from said envelope by way of the other of said openings.

13. The expander of claim 1, wherein each of said handles includes a looped section of the respective end portion and the size of at least one of said looped sections is adjustable to thereby change the overall length of said envelope.

14. The expander of claim 1, wherein the combined length of said end portions exceeds the length of said median portion in unstretched condition of said elastic element.

* * * * *